US008011963B2

(12) United States Patent
Atkinson et al.

(10) Patent No.: US 8,011,963 B2
(45) Date of Patent: Sep. 6, 2011

(54) FILTERED POWER CONNECTOR

(75) Inventors: Prescott Atkinson, Nottingham, NH (US); Mark W. Gailus, Concord, MA (US)

(73) Assignee: Amphenol Corporation, Wallingford Center, CT (US)

( * ) Notice: Subject to any disclaimer, the term of this patent is extended or adjusted under 35 U.S.C. 154(b) by 13 days.

(21) Appl. No.: 12/618,622

(22) Filed: Nov. 13, 2009

(65) Prior Publication Data

US 2010/0124848 A1 May 20, 2010

Related U.S. Application Data

(60) Provisional application No. 61/114,899, filed on Nov. 14, 2008.

(51) Int. Cl.
*H01R 13/66* (2006.01)

(52) U.S. Cl. ..... 439/620.09

(58) Field of Classification Search ..... 439/620.05–620.07, 620.09–620.14
See application file for complete search history.

(56) References Cited

U.S. PATENT DOCUMENTS

| | | | | |
|---|---|---|---|---|
| 3,854,107 | A | 12/1974 | Tuchto et al. | |
| 4,868,732 | A | 9/1989 | Gillett | |
| 5,456,619 | A | 10/1995 | Belopolsky et al. | |
| 5,488,540 | A | 1/1996 | Hatta | |
| 6,807,066 | B2 * | 10/2004 | Hayama et al. | 361/788 |
| 7,285,019 | B2 * | 10/2007 | Sakai et al. | 439/620.09 |
| 2001/0044227 | A1 | 11/2001 | Boutros et al. | |
| 2001/0045873 | A1 | 11/2001 | Suzuki et al. | |
| 2005/0225955 | A1 * | 10/2005 | Grebenkemper et al. | 361/780 |
| 2005/0239331 | A1 | 10/2005 | Bourdykina et al. | |

OTHER PUBLICATIONS

Filter Connectors and Adapters, http://www.conec.com/section1/filter.connectors.html, downloaded Nov. 13, 2009.
L-Ferrite Filter Technical Information, http://www.conec.com/section1/1/pg131.php3, downloaded Nov. 13, 2009.
SH Series—D-Sub, E-tec Interconnect pp. 37-38, downloaded Aug. 22, 2008.
Technical Data—D-Sub Connectors, E-tec Interconnect, p. 64, downloaded Aug. 22, 2008.
Filtered D-Sub Connector, IN2CONNECT, http://www.in2connect.uk.com/filter-d.html, 2004, downloaded Aug. 22, 2008.
Custom EMI Filtered D-sub Connector, http://directindustry.com/prod/spectrum-control/custom-emi-filtered-d-sub-connecto. . ., downloaded Aug. 22, 2008.

(Continued)

*Primary Examiner* — Ross N Gushi
(74) *Attorney, Agent, or Firm* — Wolf, Greenfield & Sacks, P.C.

(57) ABSTRACT

An improved power connector provides improved signal integrity in an interconnection system. The connector includes a filter element between a supply contact and a return contact. The filter element may be primarily capacitive, but may also include a resistance and a ferrite member. For connectors that include multiple sets of supply and return contacts, a single filter element may be included, or multiple filter elements may be included between multiple pairs of power and return contacts. The filter element may be formed within a connector housing or otherwise incorporated when the connector is manufactured. Alternatively, the filter element may be inserted into a receptacle such that filtering may be selectively incorporated as the connectors are used. When connected to a conducting loop for carrying power supply, the filter element provides substantially zero attenuation at frequencies below about 50 MHz and in excess of 10 dB of attenuation over a range that extends above 500 MHz.

28 Claims, 13 Drawing Sheets

OTHER PUBLICATIONS

EMI & ESD Protected USB Connectors, http://www.directindustry.com/scripts/go__to__web.php, downloaded Aug. 22, 2008.
D-Sub Filter Connectors, http://compel.it/news/asp?news=11, downloaded Nov. 13, 2009.
Filtered D-Sub Connectors, http://www.photonicsonline.com/product.mvc/Filtered-D-Sub-Connectors-001, downloaded Aug. 22, 2008.
Signal and Power Integrity, http://home.att.net/~istvan.novak/, Jun. 17, 2008, downloaded Aug. 22, 2008.
Table of Contents from: Novak-Miller, *Frequency-Domain Characterization of Power Distribution Networks*, Artech House, Jul. 2007.
Filtered military circular style cable-to-cable or cable-to-cabinet connectors, http://www.glenair.com/interconnects/filter/, 2007, downloaded Nov. 13, 2009.
Filtered military circular style cable-to-cable or cable-to-cabinet connectors, http://www.glenair.com/interconnects/filter/pdf/overview.pdf, 2008, downloaded Nov. 13, 2009.
Multilayer Ceramic Planar Capacitor Arrays, http://www.glenair.com/interconnects/filter/pdf/capacitor__arrays.pdf, 2008, downloaded Nov. 13, 2009.
Compact Power Connectors, pp. 88-90, http://www.andersonpower.com/litlib/files.html/download/493-298.3kb pp. 90-92, downloaded Nov. 13, 2009.
Table of Contents from: *Power Distribution Network Design Methodologies*, International Engineering Consortium, Mar. 2008.
International Search Report for PCT/US2009/006058, mailed Jun. 28, 2010.

* cited by examiner

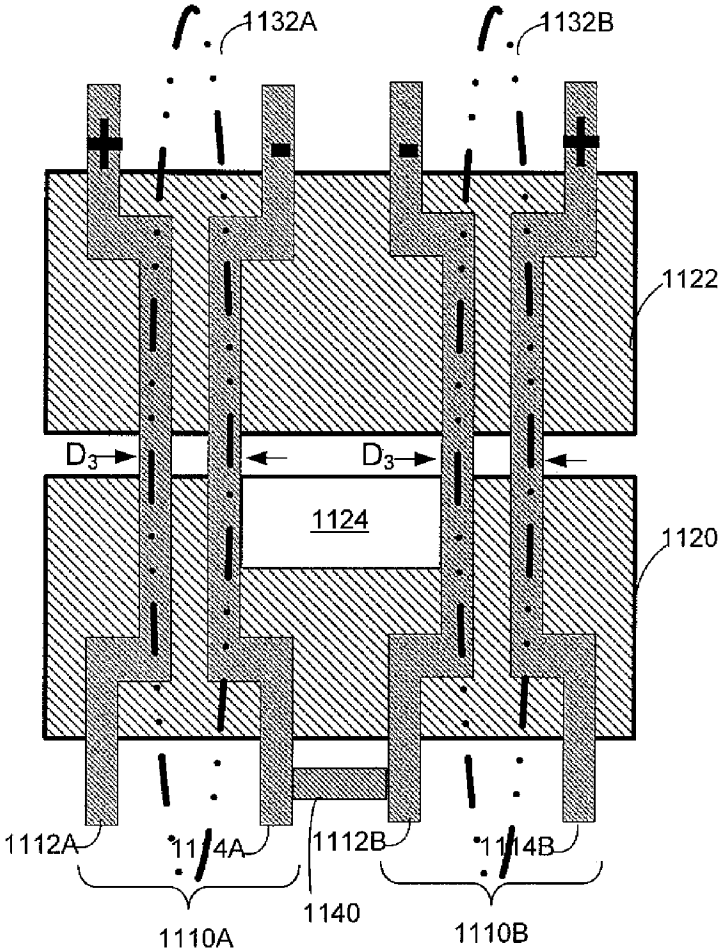
FIG. IID
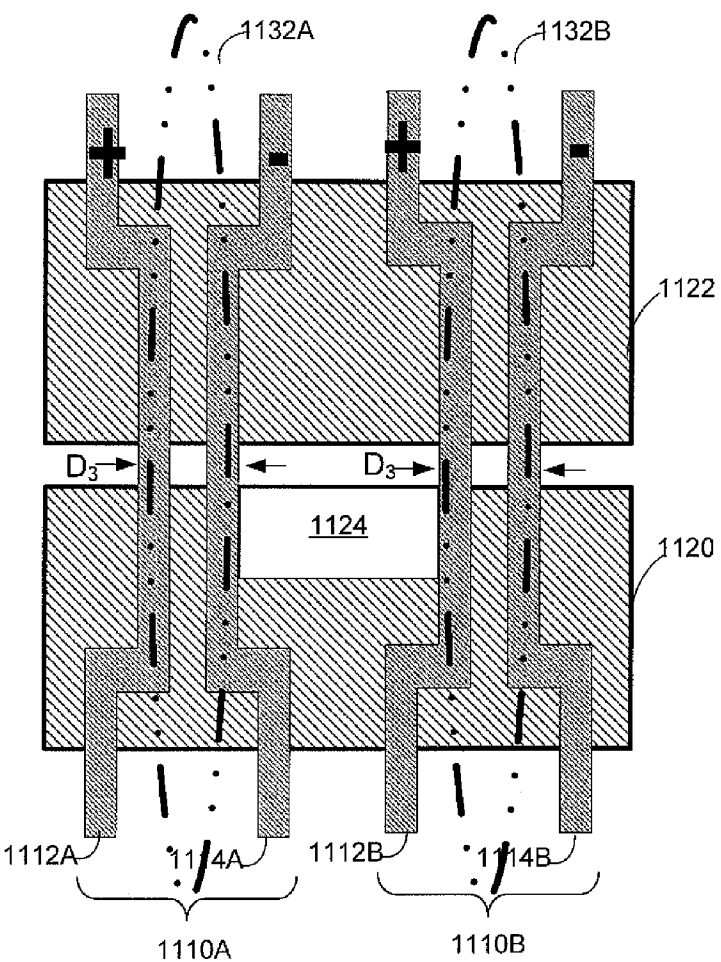
FIG. IIC

FILTERED POWER CONNECTOR

BACKGROUND

1. Field of Invention

This invention relates generally to electrical interconnection systems and more specifically to improved power connectors.

2. Discussion of Related Art

Electrical connectors are used in many electronic systems. It is generally easier and more cost effective to manufacture a system on several printed circuit boards (PCBs) that are connected to one another by electrical connectors than to manufacture a system as a single assembly. A traditional arrangement for interconnecting several PCBs is to have one PCB serve as a backplane. Other PCBs, which are called daughter boards or daughter cards, are then connected through the backplane by electrical connectors in an electrical interconnection system.

Some of the electrical connectors are designed to carry high speed data signals between the PCBs. They are referred to as signal connectors, and they typically have conductive elements that are shaped to provide a desired impedance or other properties to allow data signals to be transmitted with high integrity. Some other electrical connectors, called power connectors, are designed to carry larger amounts of current, and can be used to couple a supply of power from a subassembly connected to the backplane to the daughter cards also connected to the backplane. Typically, a power connector is configured with a supply path and a return path, forming a closed circuit that allows a flow of current. Unlike signal connectors, power connectors have conductive elements adapted to carry large amounts of current, such as 10 amperes or more.

In recent years, electronic systems have generally become smaller, faster and functionally more complex. These changes mean that the number of circuits in a given area of an electronic system, along with the frequencies at which the circuits operate, has increased significantly. Modern systems pass more data between PCBs and require electrical connectors that are electrically capable of handling more data at higher speeds than connectors of even a few years ago.

One of the difficulties in making a high density, high speed connector is that electrical conductors in the connector can be so close together that there can be electrical interference between adjacent signal conductors. Accordingly, a focus for improving signal integrity in an interconnection system has been to reduce interference between signal conductors that carry high speed data signals.

Various approaches have been used for this purpose, including incorporating shielding between the signal conductors, changing the shape or position of the signal conductors relative to ground conductors and incorporating magnetically or electrically lossy or absorptive material into the connector.

SUMMARY

Instead of, or in addition to, techniques that directly impact the integrity of signals carried in signal conductors, an improved interconnection system is provided with a power connector into which a filter element may be incorporated. The filter element reduces high frequency noise that is coupled through the power connector to electronic assemblies joined by the interconnection system. The filter element may have component values, such as capacitance, resistance, and/or inductance, that, in combination with the other elements that form a conducting loop for carrying power for a subassembly, attenuate high frequency signals without affecting the ability of the connector to deliver power.

The filter element may be attached to conductive elements within the power connector. The inventors have recognized that the attachment mechanism may impact the effectiveness of the filter element, and in some embodiments the filter element may make electrical contact across a wide area of the conductive elements. Such attachment may be achieved using a filter element with wide terminals. Alternatively, the filter element may include multiple components that are separately attached adjacent opposing edges of the conductive elements.

The mechanism for attaching the filter elements to the conductive elements may be constructed to allow the filter element to be installed in the power connector after the power connector is manufactured. In this way, in some embodiments, filtering may be selectively included in the power connector. Such an attachment may be achieved by forming a receptacle region in a housing of the connector that is shaped to receive a filter element. Tabs coupled to conductive elements intended to be supply and return elements may extend into the region. The tabs may form a separable spring contact to secure the filter element within the receptacle region of the connector housing. Though, other types of attachment are possible, including solder securing the filter element to the tabs.

The inventors have recognized and appreciated that, though conventionally ferrite beads have been used to reduce unwanted signals coupled through power conductors, the shape and placement of a ferrite filter may impact performance of the power connector. Accordingly, in some embodiments, a ferrite member used as part of a filter element is placed on either or both sides of a power conductor, but without encircling the power conductor.

In some embodiments, a power connector is provided, comprising a housing, a first plurality of power contact elements within the housing, and a second plurality of power contact elements within the housing. A filter element is disposed within the housing, between the first plurality and the second plurality of power contact elements, and is electrically coupled between a power contact element of the first plurality of contact elements and a power contact element of second plurality of contact elements.

In accordance with further embodiments of the invention, a power connector is provided, comprising a housing and first and second power contact elements within the housing. The first power contact element is designated as a supply contact, and the second power contact element is designated as a return contact. A filter element is disposed within the housing, between the first power contact element and the second power contact element. The filter element has properties such that, while the first and second power contact elements are connected in a loop carrying a current of 10 Amperes, the loop provides substantially no attenuation at frequencies below 5 MHz and an attenuation of greater than 10 dB over the range of 50 MHz to 500 MHz. The loop also provides no gain above 10 dB at frequencies less than 500 MHz.

In some further embodiments, a housing of a power connector comprising first and second power contact elements comprises a region adapted and configured to receive a filter element within the housing, the region being disposed between the first power contact element and the second power contact element.

In accordance with further embodiments of the invention, a method of operating a circuit assembly comprising a power connector is provided. The method comprises coupling power from a power supply to a circuit assembly through a separable connector that comprises a plurality of power contact elements, each power contact element carrying current of at least 10 Amperes. The method further comprises filtering the power using a filter element disposed within the connector, the filter element electrically connected between a first power contact element and a second power contact element of the plurality of power contact elements, and the filter element having a capacitance in the range of 0.05 to 0.2 microFarads, a resistance in the range of 0.1 to 1 Ohms, and an inductance less than 10 nanoHenries.

BRIEF DESCRIPTION OF DRAWINGS

In the drawings:

FIGS. 11C and 11D illustrate the power connector of FIG. 11A configured for low inductance operation.

DETAILED DESCRIPTION

Figure 1:
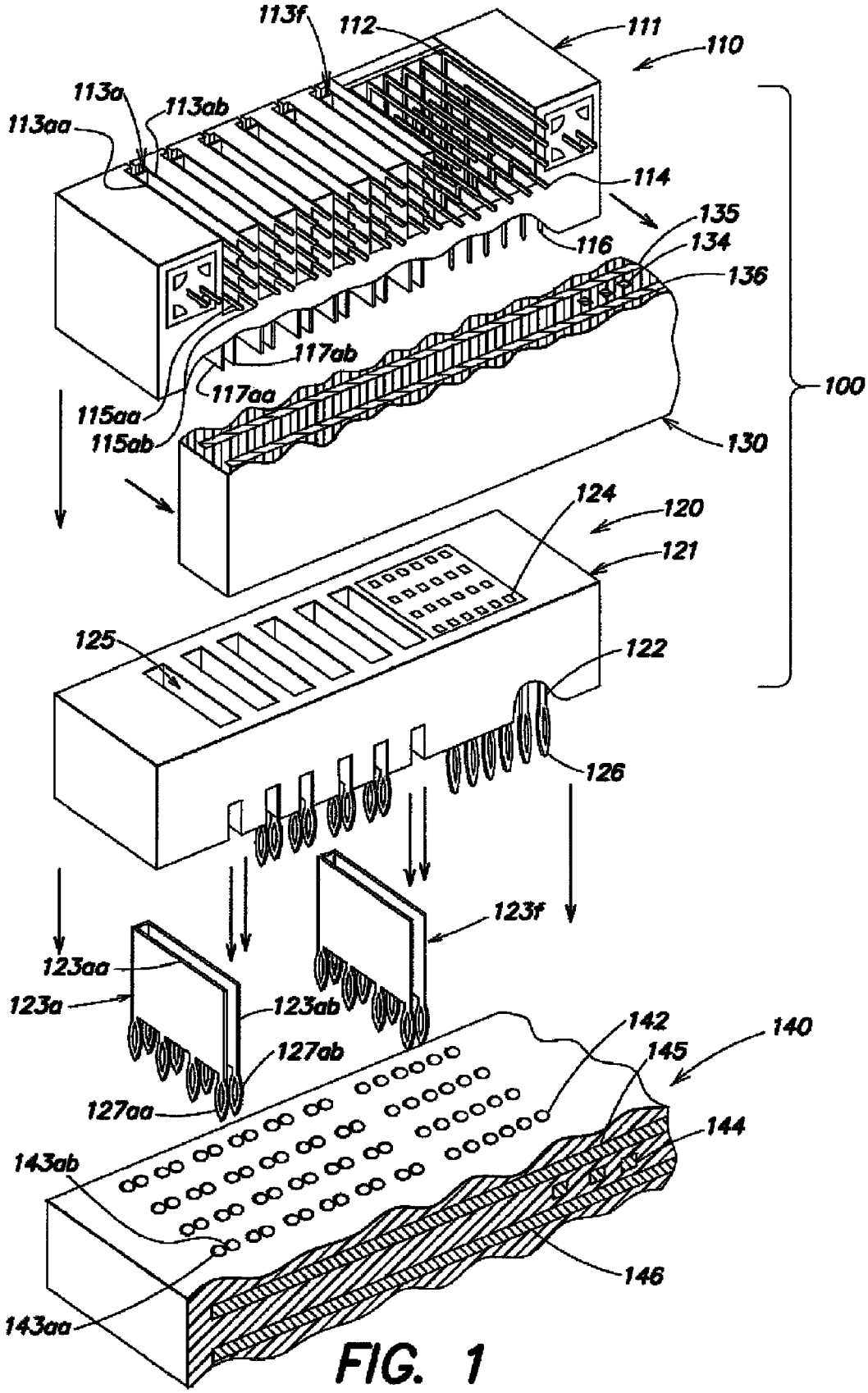
FIG. 1 is a perspective view of a portion of a conventional electrical interconnection system that includes a backplane power connector and a daughter card power connector.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," "having," "containing," or "involving," and variations thereof herein, is meant to encompass the items listed thereafter and equivalents thereof as well as additional items.

Referring to FIG. 1, a portion of a conventional electrical interconnection system is shown, comprising a power connector 100. Power connector 100 is an example of a power connector that may be improved through the incorporation of one or more filter elements, as described below. As shown in FIG. 1, power connector 100 comprises two connectors 110 and 120 that are adapted to mate with each other. Connector 110 is further adapted to mount onto a substrate, here illustrated as PCB 130. Similarly, connector 120 is also adapted to mount onto a substrate, here illustrated as PCB 140. Together, connectors 110 and 120 provide electrically conducting paths between PCBs 130 and 140.

In some embodiments, PCBs 130 and 140 may be a daughter card and a backplane, respectively. In such an embodiment, connectors 110 and 120 may be referred to as, respectively, a daughter card power connector and a backplane power connector. Though not expressly shown, the interconnection system may interconnect multiple daughter cards to backplane 140, and may provide electrically conducting paths between components on the daughter cards via backplane 140. Accordingly, the number of PCBs or other substrates connected through an interconnection system is not a limitation on the invention described herein. Furthermore, in addition to power connectors such as power connector 100 shown in FIG. 1, the interconnection system may comprise signal connectors that are adapted to carry high speed data signals. The interconnection system may further comprise mechanical guidance and/or other alignment features that cooperate to properly align electrical contacts, so that the desired electrical connections are made upon mating of the connectors.

All of the features of an interconnection system described above may be as known in the art, as the invention is not limited in this regard. For example, even though FIG. 1 illustrates a particular type of right angle connector, the invention may be broadly applied in different types and combinations of electrical connectors, including right angle connectors, mezzanine connectors, card edge connectors and chip sockets.

In the embodiment illustrated in FIG. 1, daughter card power connector 110 and backplane power connector 120 comprise, respectively, insulative housings 111 and 121. These housing may be formed in any suitable way using any suitable materials, as the invention is not limited in this regard. For example, housings 111 and 121 may be molded using a dielectric material such as plastic or nylon. More specifically, they may be formed using liquid crystal polymer (LCP), polyphenyline sulfide (PPS), high temperature nylon, polypropylene (PPO), and/or any other suitable dielectric material.

As shown in FIG. 1, daughter card power connector 110 and backplane power connector 120 further comprise a plurality of conductive elements, for example, conductive elements 112 and 113*a* of daughter card power connector 120 and conductive elements 122 and 123*a* of backplane power connector 120. Each of these conductive elements may be formed of any suitable conductive materials, including metal alloys (e.g., a copper alloy), and may have any suitable configuration. For example, conductive element 112 may be substantially linear, whereas conductive element 113*a* may comprise two conductor portions, 113*aa* and 113*ab*, that are substantially parallel to each other. The portions 113*aa* and 113*ab* may be formed integrally, for instance, by stamping a sheet of conductive material to form one or more openings and then folding the sheet along the openings. However, it should be appreciated that the invention is not limited to the particular configurations of conductive elements shown in FIG. 1, as other configurations may also be suitable. Also, the invention is not limited to any particular methods for manufacturing the conductive elements used in the power connectors.

In the embodiment illustrated in FIG. 1, each of the conductive elements comprises a contact tail and a mating contact portion that are electrically coupled to each other via an intermediate portion of the conductive element. Typically, the contact tail is configured to be connected to a PCB and become electrically coupled with one or more conductive elements within the connected PCB. For example, conductive elements 112 and 113*a* of daughter card power connector 110 comprise, respectively, contact tail 114 and contact tails 115*aa* and 115*ab* (here shown as pins), each of which is configured to be inserted into a via hole (not shown) on daughter card 130. When inserted, contact tail 114 may become electrically coupled to a trace 134 within daughter card 130, and contact tails 115*aa* and 115*ab* may become electrically coupled to a plane 135 within daughter card 130. Similarly, conductive elements 122 and 123*a* of backplane power connector 120 comprise, respectively, contact tail 126 and contact tails 127*aa* and 127*ab* (here shown as press fit "eye of the needle" contacts). Contact tails 126, 127*aa*, and 127*ab* are configured to be inserted into, respectively, via holes 142, 143*aa*, and 143*ab* on backplane 140. When inserted, contact tail 126 may become electrically coupled with a trace 144 within backplane 140, and contact tails 127*aa* and 127*ab* may become electrically coupled with a plane 145 within backplane 140.

It should be appreciated that the contact tails discussed above and their corresponding attachment structures on PCB 130 and 140 (e.g., via holes) may be of any suitable type and configuration, as the invention is not limited in this regard. For example, instead of, or in addition to, the pins and "eye of the needle" contacts shown in FIG. 1, other configurations such as surface mount elements and solderable pins may also be employed.

Having described contact tails of the conductive elements, mating contact portions of the conductive elements will now be described in further detail. As discussed above, daughter card power connector 110 and backplane power connector 120 are configured to mate with each other to provide electrically conducting paths. The mating contact portion of a conductive element in daughter card power connector 110 is configured to mate with the mating contact portion of a corresponding conductive element in backplane power connector 120 to electrically connect the two conductive elements. For example, as shown in FIG. 1, conductive element 112 of daughter card power connector 110 comprises a mating contact portion 116 that is configured to mate with a mating contact portion of conductive element 122 of backplane power connector 120. Particularly, mating contact portion 116 is shaped as a pin and is configured to be inserted into a cavity 124 in backplane power connector 120. Once inserted in to cavity 124, mating contact portion 116 may come into contact with a mating contact portion (not shown) of conductive element 122 and become electrically coupled to conductive element 122.

FIG. 1 also shows another type of mating contact portions. For example, conductive element 113*a* comprises mating contact portions 117*aa* and 117*ab*, which are shaped as blades and are adapted to be inserted into a cavity 125 in backplane power connector 120. These mating contact portions may be biased outward, so that when inserted into cavity 125 the mating contact portions are held by spring force against respective mating contact portions of conductive element 123*a* of backplane power connector 120. As shown, conductive element 123*a* also comprises two conductor portions 123*aa* and 123*ab* and, when daughter card connector 110 and backplane connector 120 are mated together, mating contact portions 117*aa* and 117*ab* of conductive element 113*a* may press against mating contact portions of conductor portions 123*aa* and 123*ab*, respectively, thereby creating an electrical connection between conductive elements 113*a* and 123*a*.

As with contact tails of the conductive elements, it should be appreciated that the invention is not limited to the particular types of mating contact portions shown in FIG. 1, as other types may also be suitable. For example, the mating contact portions may be formed as compliant beams or non-compliant blades or plates.

In the embodiment illustrated in FIG. 1, connectors 110 and 120 comprise conductive elements that are shaped or configured differently. These different conductive elements may be designed for different purposes. For example, conductive elements 113*a*, 113*f*, 123*a*, and 123*f* may be designed to carry a supply of power and may be referred to as power conductors, whereas conductive elements 112 and 122 may be designed to carry signals and may be referred to as signal conductors. Unlike conductive elements in a signal connector, which are adapted to carry high speed data signals, conductive elements 112 and 122 may be intended to carry low speed control signals associated with power supply functions. However, it should be appreciated that the invention is not limited by the intended purposes described above. The invention is also not limited by the number or types of conductive elements that are present within a connector housing.

As known in the art, power conductors in a power connector are configured to provide a supply path and a return path between connected PCBs. These paths may be part of a closed current loop for providing power to circuits on the connected PCBs. In particular, power conductors on the supply path may be electrically coupled to supply planes on the connected PCBs and may be referred to as supply conductors, whereas power conductors on the return path may be electrically coupled to ground planes on the connected PCBs and may be referred to as return conductors. For example, in the embodiment illustrated in FIG. 1, plane 135 on daughter card 130 and plane 145 on backplane 140 may be supply planes, and conductive elements 113*a* and 123*a* may be supply conductors that provide an electrical connection between planes 135 and 145. Similarly, plane 136 on daughter card 130 and plane 146 on backplane 140 may be ground planes, and conductive elements 113*f* and 123*f* may be return conductors that provide an electrical connection between planes 136 and 146. In this configuration, a current may flow from supply plane 145 of backplane 140 to supply plane 135 of daughter card 130 via conductive elements 123*a* and 113*a*, and then through a circuit on daughter card 130 to reach ground plane 136 of daughter card 130, eventually returning to ground plane 146 of backplane 140 via conductive elements 113*f* and 123*f*.

A power supply for the PCBs may emit high frequency noise, which may be coupled through the power conductors to the daughter cards and may interfere with the operations of circuits on the daughter cards. In accordance with some embodiments of the invention, an interconnection system having a power connector such as power connector 100 described above may be improved by incorporating a filter element to reduce the high frequency noise coupled through the power conductors. The filter element may have component values such as, capacitance, resistance, and/or inductance that, in combination with the other elements that form the conducting loop for carrying power, attenuate high frequency signals without affecting the ability of the interconnection system to deliver power.

The filter element may be attached to conductive elements within the power connector. In some embodiments, the filter element may be soldered onto the conductive elements before the conductive elements are inserted into the housing of the power connector. Alternatively, the filter element may be molded into the housing of the power connector, with a reflow operation used to form solder joints between the ends of the filter element and the conductive elements. Other methods for attaching the filter element to the conductive elements may also be suitable, as the invention is not limited in this respect.

Figure 2:
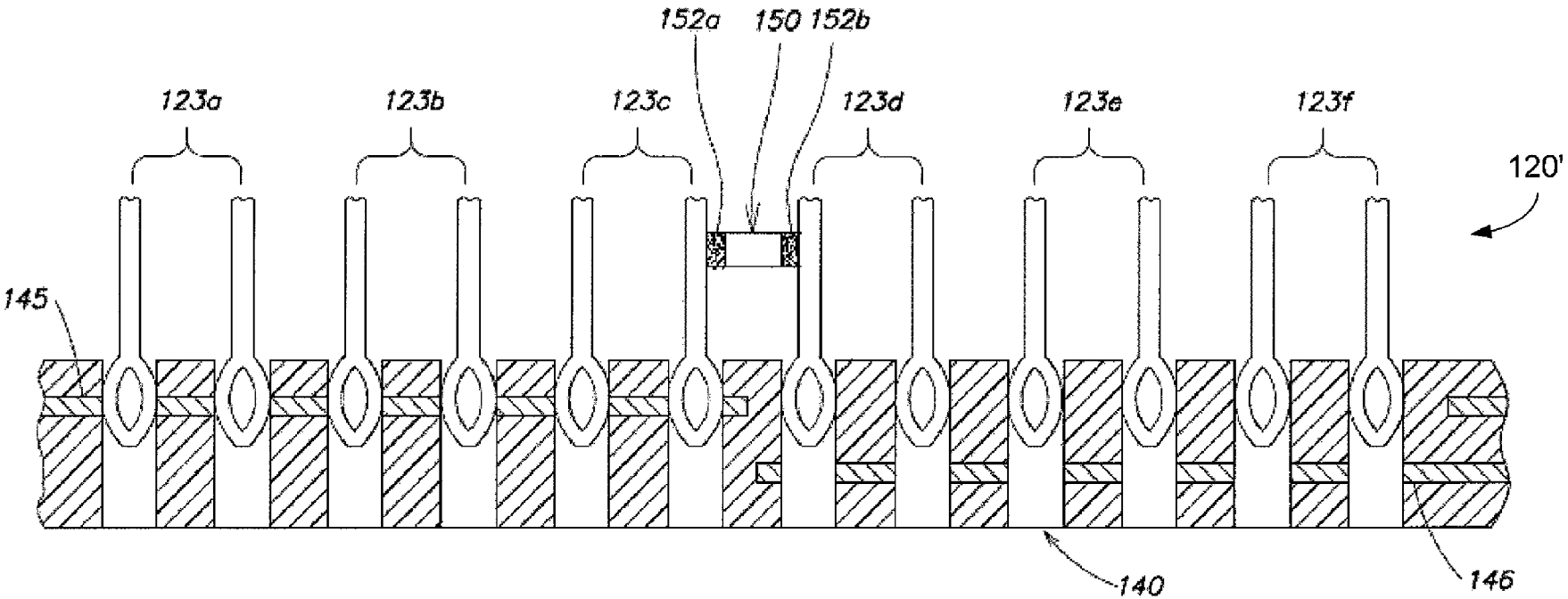
FIG. 2 is a schematic cross-sectional representation of a portion of an improved interconnection system, showing a filter element incorporated between two conductive elements in accordance with some embodiments of the invention.

Turning now to FIG. 2, a cross section of an assembly is shown, comprising a portion of backplane 140 and conductive elements 123*a-f* of an improved backplane power connector 120' in accordance with some embodiments of the invention. Each of conductive elements 123*a-f* comprises a pair of contact tails that are inserted into via holes on backplane 140 to provide electrical connections between conductive elements 123*a-f* and conductive elements within backplane 140.

As shown in FIG. 2, conductive elements 123*a-f* are divided into two groups, 123*a-c* and 123*d-f*. Conductive elements 123*a-c* are electrically coupled to plane 145, and conductive elements 123*d-f* are electrically coupled to plane 146. As discussed above, plane 145 may be a supply plane, and conductive elements 123*a-c* may be supply conductors. Similarly, plane 146 may be a ground plane, and conductive elements 123*d-f* may be return conductors.

A filter element 150 is disposed between these two groups of conductive elements and, more particularly, between conductive elements 123*c* and 123*d*. Filter element 150 comprises two terminals, each of which is accessible through a conductive end cap that is electrically connected to a conductive element. In particular, one of the terminals is electrically connected to end cap 152*a*, which is electrically connected to conductive element 123*c*. The other terminal is electrically connected to end cap 152*b*, which is electrically connected to conductive element 123*d*. Internally, filter element 150 may comprise a combination of capacitors, resistors, and/or other electronic components. Examples of suitable combinations will be further discussed below.

Figure 3:
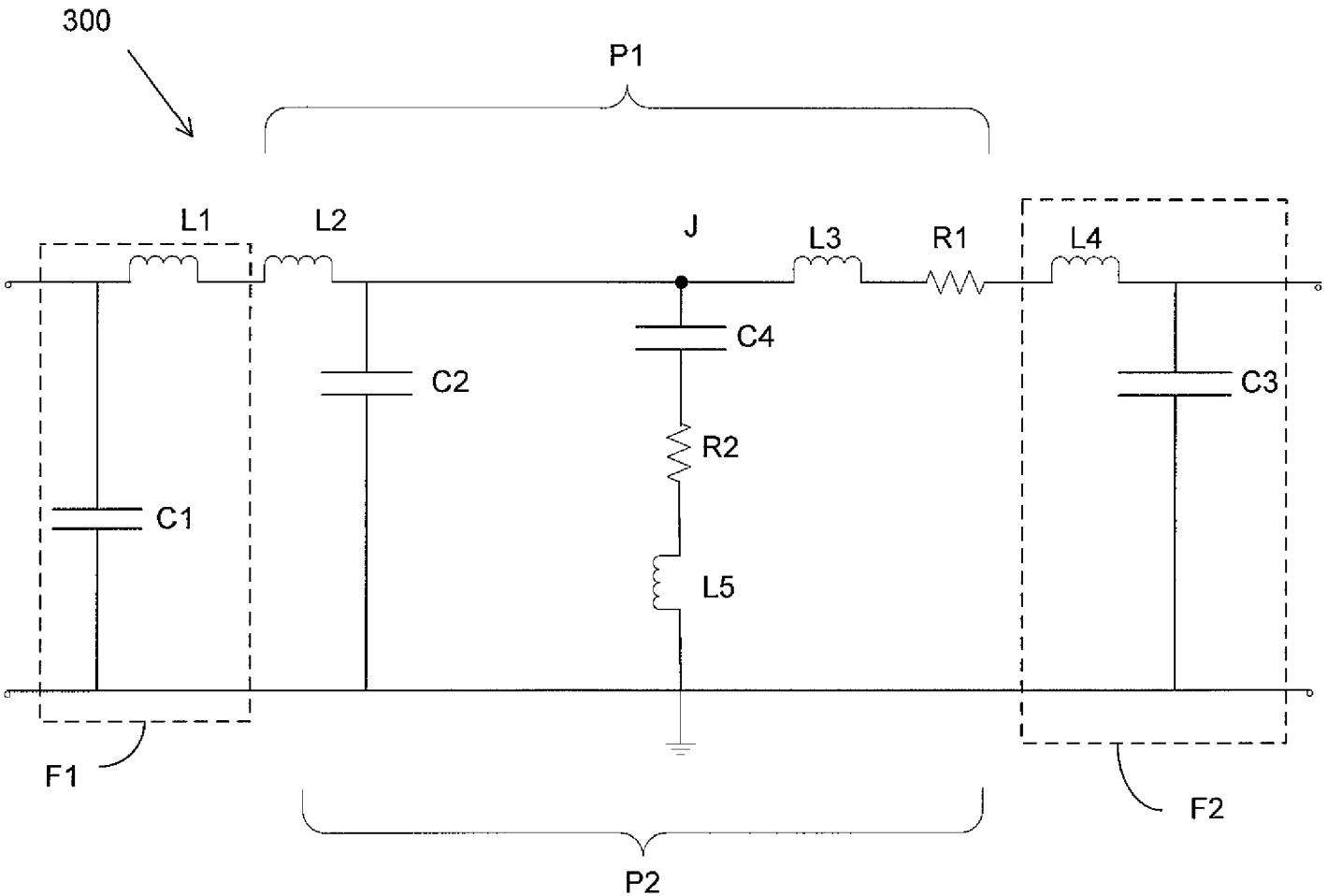
FIG. 3 is a diagram representing an equivalent circuit for the improved interconnection system of FIG. 2, in which the filter element comprises a capacitor in series with a resistor.

FIG. 3 shows an example of an equivalent circuit 300 representing an improved power connector 100' (not shown), with the daughter card power connector and backplane power connector mated together and a filter element incorporated into either the daughter card power connector or the backplane power connector. The footprint F1 may represent a portion of daughter card 130 to which power connector 100' is attached. The inductance L1 and capacitance C1 may represent, respectively, the inductance and capacitance of that portion of daughter card 130. Similarly, the footprint F2 may represent a portion of backplane 140 to which power connector 100' is attached. The inductance L4 and capacitance C3 may represent, respectively, the inductance and capacitance of that portion of back plane 140.

Power connector 100' is represented in circuit 300 by two paths P1 and P2 between the footprints F1 and F2. The capacitance of power connector 100' is represented as a capacitance C2 between the paths P1 and P2, and the resistance of power connector 100' is represented as a resistance R1 along path P1. Power connector 100' may also have an inherent inductance. Because filter element 150 (FIG. 2) is electrically coupled to some intermediate portions of power conductors within power connector 100', the inherent inductance associated with power connector 100' is divided into two components, L2 and L3. Thus, L2 may represent the inherent inductance of the portion of power connector 100' between daughter card 130 and filter element 150, whereas L3 may represent the inherent inductance of the portion of power connector 100' between backplane 140 and filter element 150.

Filter element 150 is represented in circuit 300 as a series comprising a capacitance C4, a resistance R2, and an inductance L5, disposed between the paths P1 and P2. In constructing a connector with a filter element, the electrical characteristics of the filter element, here represented as C4, R2, and L5, may be selected to provide attenuation in some preferred range of frequencies. For example, it be may desirable that high frequency signals are attenuated, but low frequency signals are relatively unaffected. More specifically, it may be desirable to provide attenuation at frequencies above 50 MHz up to at least 500 MHz, while leaving frequencies at 5 MHz or below relatively unaffected. To achieve these or similar attenuation characteristics, capacitance C4 may be chosen to be between 0.05 microfarads and 0.2 microfarads and resistance R2 may be chosen to be between 0.1 ohms and 1 ohm. As a specific example, the capacitance may be about 0.1 microfarads and the resistance may be about 0.62 ohms.

In some embodiments, the total inductance of filter element 150 may be as small as possible. Accordingly, no inductive element may be expressly included in filter element 150. In that case, inductance L5 shown in FIG. 3 may correspond to an inherent inductance of filter element 150, and its value may vary depending on how the filter element 150 is constructed and/or incorporated into power connector 100'. As will be explained in greater detail below, it may be desirable to ensure that L5 is small. In some embodiments, the inherent inductance of a filter element will be about 1.2 nanohenries.

It should be appreciated that the invention is not limited to filter elements with the specific component values mentioned above, as other values may also be suitable. For example, a filter element may consist of a capacitor in series with a resistor, or a capacitor by itself. In the latter case, resistance R2 in circuit 300 may be very small.

Figure 4:
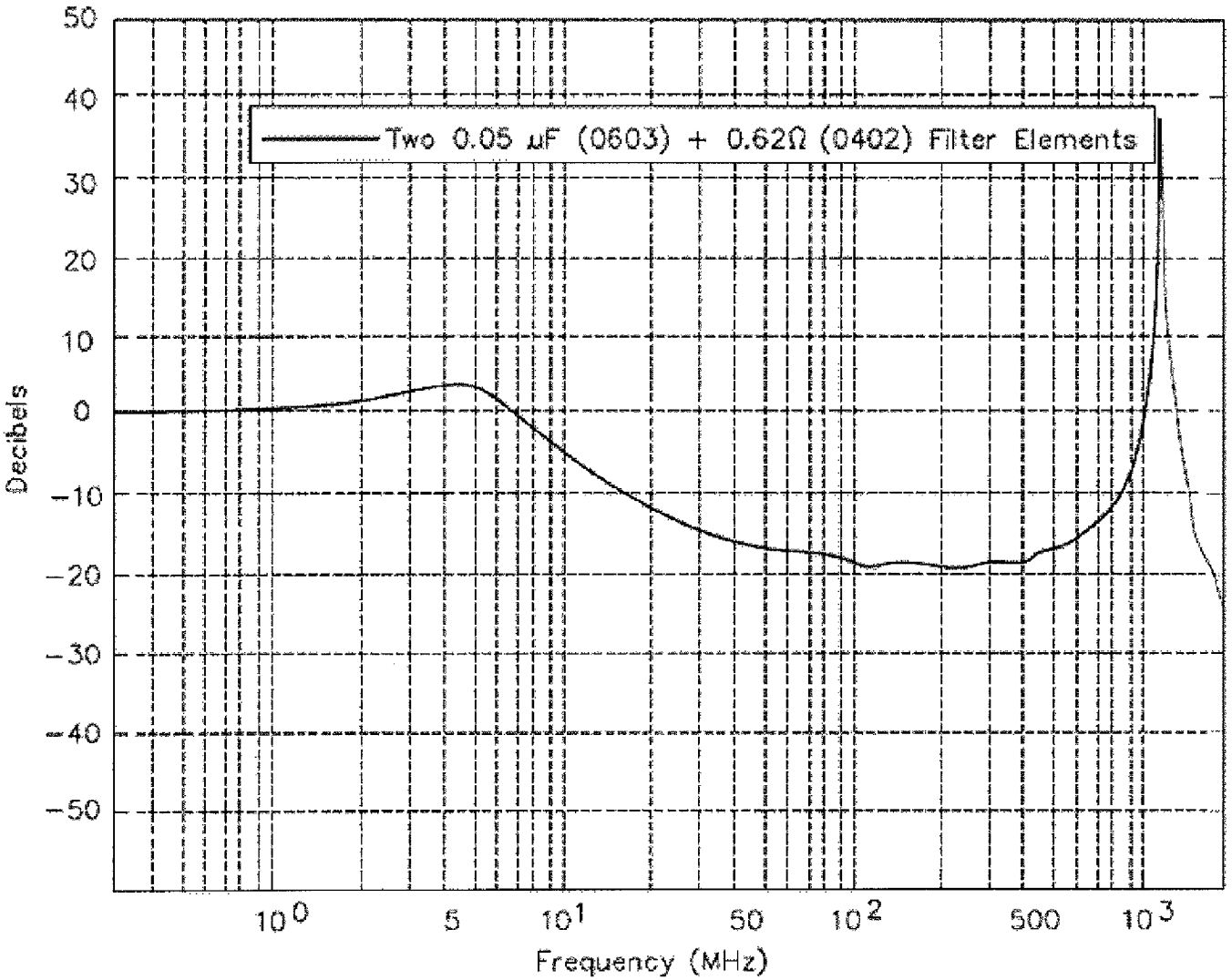
FIG. 4 is a graph showing attenuation at a range of frequencies in an interconnection system with a power connector having filter elements in accordance with some embodiments of the invention, derived using an equivalent circuit model as in FIG. 3.

The inventors have recognized that filter elements such as filter element 150 may be effective in reducing noise coupled through power connectors. For example, in some embodiments, attenuation in the range of 50 MHz to 500 MHz may be achieved by incorporating one or more filter elements. FIG. 4 illustrates attenuation (in decibels) measured at different frequencies when two filter elements are incorporated, each filter element having a capacitance of 0.05-microfarad and a resistance of 0.62-ohm. As can be seen from FIG. 4, in the illustrated embodiment, the filter elements should cause substantially no attenuation at frequencies below 5 MHz. Because power supplied by a power supply should have frequency components well below 5 MHz, the presence of the filter elements does not affect the connector's ability to deliver power. Between 50 MHz and 500 MHz, the attenuation is at least 10 decibels, and, more particularly, between 15 and 20 decibels. At some higher frequencies (e.g., just above 1 GHz), the presence of the filter elements results in an amplification of over 30 decibels, which may be caused by resonance attributable to the connector and PCB structures. However, electronic assemblies, even those operating on high frequency signals, may be less sensitive to noise on power conductors at higher frequencies than at lower frequencies. Though, in some embodiments, it may be desirable to provide less gain at higher frequencies. Such amplification may be suppressed or mitigated. For example, a ferrite or high permeability member as described below may be used to reduce the gain at higher frequencies. Alternatively or additionally, the high frequency gain may be mitigated through the correction of resonant effects inherent in the power connector structure, also as described below. Nonetheless, even without these additional measures, the presence of the filter elements does not cause a gain of more than 10 deibels at any frequency below 500 MHz.

The inventors have recognized that, at higher frequencies (e.g. between 50 MHz and 500 MHz), the amount of attenuation may be proportional to the ratio $$\frac{L5}{L1+L2}.$$

At such high frequencies, capacitance C4 may behave like a short circuit, so that the voltage at junction J shown in FIG. 3 may be proportional to the ratio $$\frac{L5}{L1+L2}.$$

Thus, at higher frequencies, the voltage at junction J may be reduced by lowering inductance L5, thereby reducing the high frequency noise that is coupled through power connector 100' to the electronic assemblies joined by the interconnection system.

To increase the effectiveness of filter element 150 in reducing high frequency noise, it may be desirable to keep L5 below 10% of L1+L2. In some embodiments, L1+L2 may be in the range of 10-20 nanohenries, in which case L5 may be no more than 1, or, in some embodiments, 2 nanohenries. In some embodiments, it may be desirable to ensure that L5 is no more than 10 nanohenries.

Figure 5A:
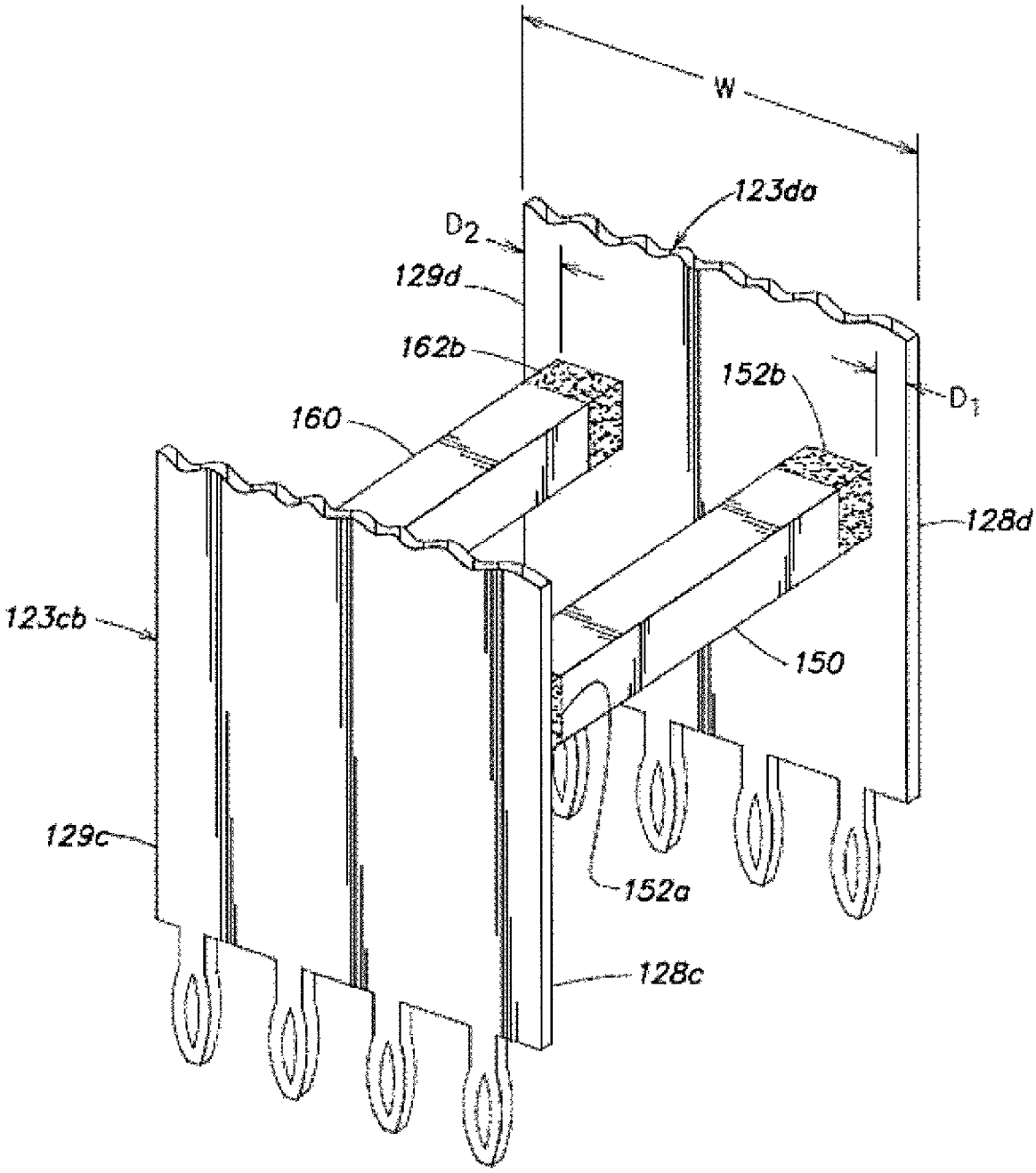
FIG. 5A is a perspective view of two conductive elements of a power connector with two filter elements positioned in accordance with some embodiments of the invention.

The inventors have further recognized that, to maintain inductance L5 at a relatively low level, it may be desirable to construct and/or incorporate filter elements in such a way that the filtering components are electrically coupled to the power conductors (e.g., conductive elements 123*c* and 123*d* of the backplane connector 120) across significant portions of the widths of the power conductors. One such embodiment is illustrated in FIG. 5A, which shows two filter elements, 150 and 160, inserted between conductor portion 123*cb* of conductive element 123*c* and conductor portion 123*ca* of conductive element 123*d*. As shown, the filter element 150 is disposed adjacent to a front vertical edge 128*c* of conductor portion 123*cb* and a front vertical edge 128*d* of conductor portion 123*da*. Moreover, filter element 150 is electrically coupled to conductor portions 123*cb* and 123*da*, respectively, via end caps 152*a* and 152*b*. Similarly, filter element 160 is disposed adjacent to back vertical edges 129*c* and 129*d* of conductor portions 123*cb* and 123*da*, and is electrically coupled to conductor portions 123*cb* and 123*da* via end caps, of which end cap 162*b* is visible in FIG. 5A.

As a specific example, each of conductor portions 123*cb* and 123*da* may have a width W of at least 0.5 cm. Filter element 150 may be placed so that a distance D1 between end cap 152*b* and front edge 128*d* is at most 0.05 cm. Similarly, filter element 160 may be placed so that a distance D2 between end cap 162*b* and back edge 129*d* is also at most 0.05 cm. Thus, filter elements 150 and 160 span, collectively, at least 80% of conductor portion 123*da* and hence at least 80% of the width of conductive element 123*d*. In this configuration, the inductance of a conducting path including filter elements 150 and 160 is less than if a single filter element were used, or if two filter elements were used, each attached near the center of conductor portions 123*cb* and 123*da*. Thus, the inductance represented as L5 in the model of FIG. 3 is effectively lowered.

Although it may be beneficial to place two filter elements relatively far apart from each other across a width of a power conductor, it should be appreciated that the invention is not limited to the particular configuration shown in FIG. 5A, nor to the particular dimensions discussed above. Other configurations or dimensions may also be suitable.

Figure 5B:
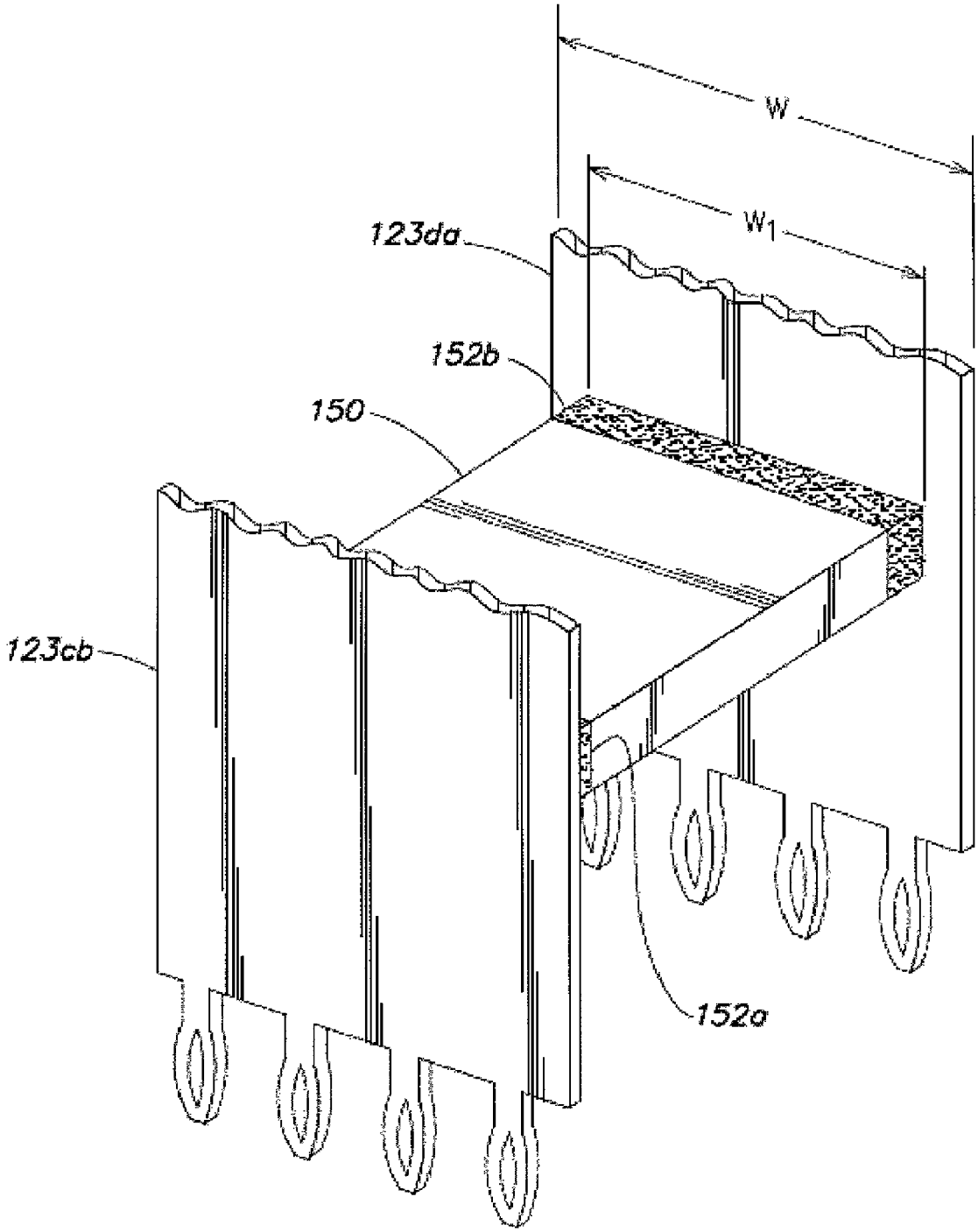
FIG. 5B is a perspective view of two conductive elements of a power connector with a wide filter element in accordance with another embodiment of the invention.

In some alternative embodiments, a single filter element with a wide cross section may also be employed, instead of or in addition to two filter elements inserted near the vertical edges of the power conductors. An example of a wide filter element is shown in FIG. 5B. In this embodiment, both filter element 150 and its end caps 152*a* and 152*b* have a wide cross section, so that filter element 150 is capable of spanning substantial portions of the widths of conductor portions 123*cb* and 123*da*. For example, the width W1 of filter element 150 may be at least 0.3 cm. More preferably, the width W1 may be at least 80% of the width W of conductor portion 123*da*. In this configuration, filter element 150 may exhibit characteristics similar to those of multiple inductances spread across the widths of conductor portions 123*cb* and 123*da*, thus lowering the inductance of the conducting path including filter elements 150.

Figure 6A:
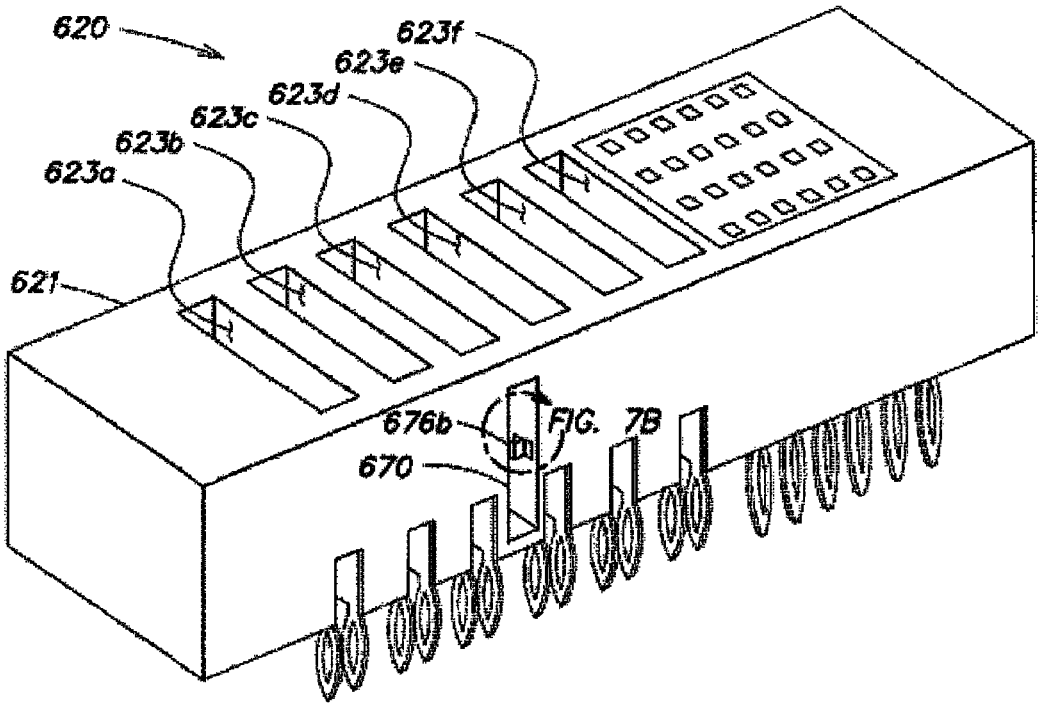
FIG. 6A is a perspective view of a backplane power connector having a receptacle formed in a housing to receive a filter element in accordance with some embodiments of the invention.
Figure 6B:
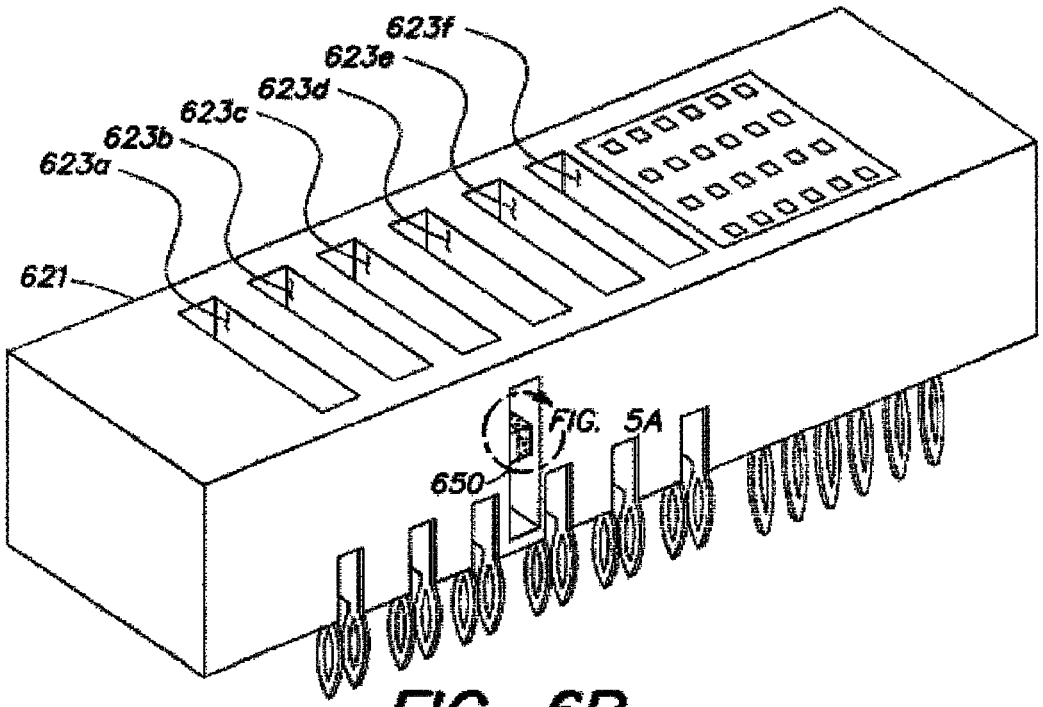
FIG. 6B is a perspective view of the backplane connector of FIG. 6A, with a filter element inserted into the receptacle.

Turning to FIGS. 6A and 6B, the inventors have appreciated that, although the invention is not limited to any particular manner in which filter elements are incorporated into a power connector, it may be advantageous to provide a power connector into which one or more filter elements may be incorporated in a convenient manner after the power connector has been manufactured. FIG. 6A-B show a power connector 620 in accordance with some embodiments of the invention. Power connector 620 has the same pattern of signal and power conductors as backplane power connector 120 shown in FIG. 1. As shown in FIG. 6A, a housing 621 of power connector 620 comprises a receptacle 670 configured to receive one or more filter elements. FIG. 6B shows power connector 620 with a filter element 650 inserted into receptacle 670. As shown, receptacle 670 is located between two groups of conductive elements, 623*a-c* and 623*d-f*. More particularly, receptacle 670 is located between conductive elements 623*c* and 623*d*. Although in the illustrated embodiment each group comprises three conductive elements, any number of conductive elements may be present in each group, as the invention is not limited in this regard.

Receptacle 670 may be configured to allow an inserted filter element to become electrically coupled to conductive elements 623*c* and 623*d*. For example, the receptacle may comprise one or more apertures in the vertical wall adjacent conductive element 623*c* and in the vertical wall adjacent conductive element 623*d*, so that an inserted filter element may come into contact with conductive elements 623*c* and 623*d*. Alternatively, receptacle 670 may comprise metal contacts that are electrically coupled to conductive elements 623*c* and 623*d*. For example, as shown in FIG. 6A, a tab 676*b* formed on an interior wall of receptacle 670 may be adapted to provide electrical connection between conductive element 623*d* and an inserted filter element.

Figure 7A:
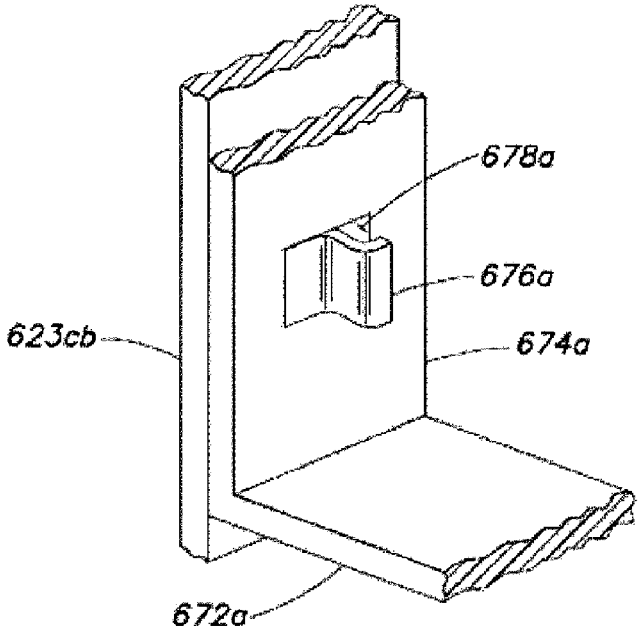
FIG. 7A is a perspective view of a portion of the interior of the receptacle of FIG. 6A, showing a tab formed on a first interior wall of the receptacle.
Figure 7B:
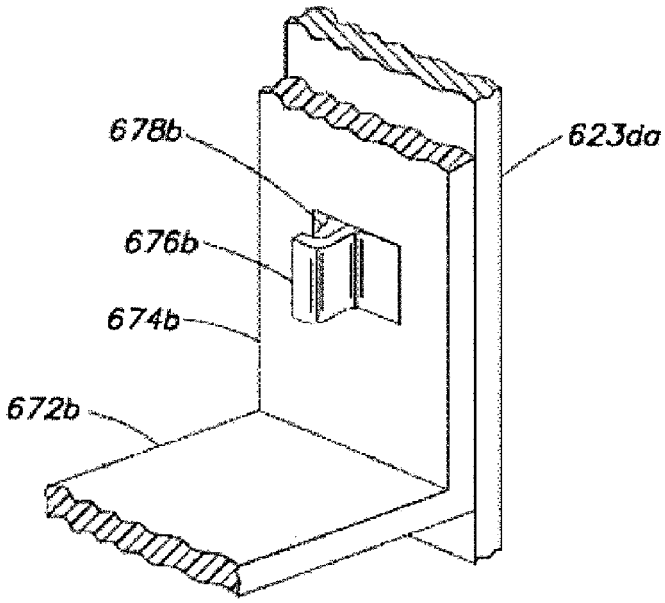
FIG. 7B is a perspective view of another portion of the interior of the receptacle of FIG. 6A, showing another tab formed on a second interior wall opposite the first interior wall.

FIGS. 7A and 7B illustrate in greater detail an example of such a contact mechanism. FIG. 7A illustrates a portion of the interior of receptacle 670, comprising a floor 672*a*, a wall 674*a*, and a tab 676*a* extending from an aperture 678*a* formed in wall 674*a*. In some embodiments, tab 676*a* may be formed of a conductive material and may be electrically connected to an adjacent conductive element through aperture 678*a*. For example, wall 674*a* may be adjacent conductor portion 623*cb* of conductive element 623*c* shown in FIG. 6, and tab 676*a* may be formed as a separate piece and attached to conductor portion 423*cb* such as by soldering or welding onto conductor portion 623*cb* through aperture 678*a*. Though, tab 676*a* may also be integrally formed with conductor portion 623C.

FIG. 7B illustrates a portion of the interior of receptacle 670 that is opposite the portion shown in FIG. 7A. For example, wall 674*a* shown in FIG. 7A and wall 674*b* shown in FIG. 7B may be opposing interior walls, and floors 672*a* and 672*b* may be part of the same interior floor. Wall 674*b* may be adjacent conductor portion 623*da* of conductive element 623*d* shown in FIG. 6, and tab 676*b* may be electrically connected with conductor portion 623*da* through aperture 678*b*.

Receptacle 670 may also comprise one or more fastening mechanisms to secure an inserted filter element in place. In some embodiments, contact mechanisms that allow electrical connections between the inserted filter element and the power conductors may also serve as fastening mechanisms. For example, in some embodiments, tabs 676*a* and 676*b* may be configured to serve as spring contacts for holding a filter element in place.

Figure 8A:
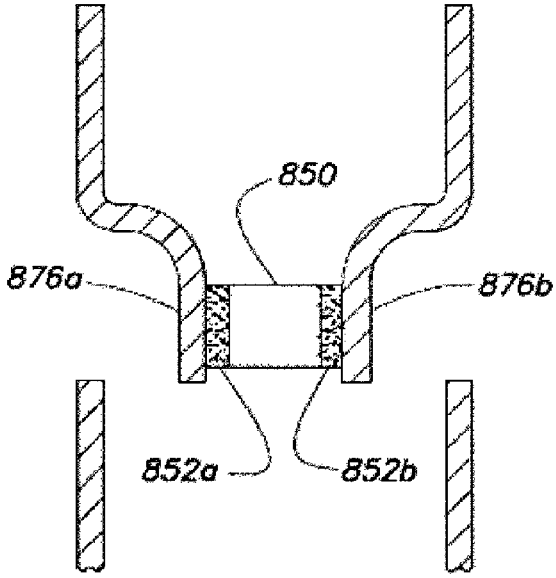
FIG. 8A is a cross-sectional view of a portion of a power connector showing a filter element held by spring force between two tabs in accordance with some embodiments of the invention.

One such embodiment is illustrated in cross-sectional view in FIG. 8A, where a filter element 850 is held in place by a spring force provided by tabs 876*a* and 876*b*. In addition, the terminals of filter element 850 are electrically coupled to tabs 876*a* and 876*b* via end caps 852*a* and 852*b*, respectively.

Figure 8B:
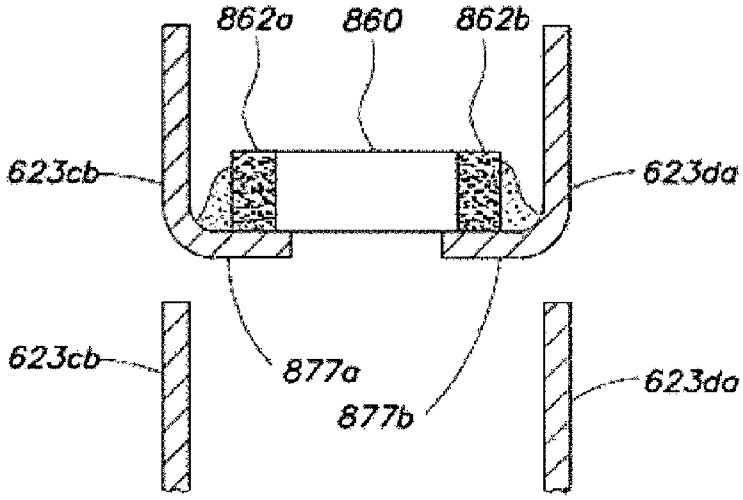
FIG. 8B is a cross-sectional view of a filter element soldered onto two tabs in accordance with some other embodiments of the invention.

Alternatively, the tabs may be configured to allow solder connections with a filter element. An example is shown in cross-sectional view in FIG. 8B, where a filter element 860 is secured between tabs 877*a* and 877*b* by soldering end caps 862*a* and 862*b* respectively onto tabs 877*a* and 877*b*. The solder connections may be formed in a reflow soldering operation or in any other suitable way.

It should be appreciated that the tabs for securing a filter element and/or providing electrical connections to the filter element may be formed in a number of different ways, as the invention is not limited in this respective. As mentioned above, the tabs may be soldered or welded onto adjacent conductive elements. Alternatively, the tabs may be formed as parts of the adjacent conductive elements. For example, tab 877*a* shown in FIG. 8B may be formed by stamping one or more slits in conductor portion 623*cb* (also shown in FIG. 7A) and bending a portion of conductor portion 623*cb* defined by the slits so that the bent portion extends through the aperture 678*a* shown in FIG. 7A to form tab 877*a*. Tab 877*b* may be formed similarly by cutting conductor portion 623*da* (also shown in FIG. 7B) and bending a cut portion through aperture 678*b* shown in FIG. 7B.

It should also be appreciated that the invention is not limited to the location and configuration of receptacle 670 described above in connection with some of the exemplary embodiments. For example, interior walls and floors of receptacle 670 shown in FIG. 7A-B may be optional. In an embodiment without such walls and floors, conductor portions 623*cb* and 623*da* may be exposed to the interior of receptacle 670. Furthermore, receptacle 670 may be formed between a pair of conductive elements other than conductive elements 623*c* and 623*d*. Or, more than one receptacle may be formed between different pairs of conductive elements, so that multiple filter elements may be incorporated.

Figure 9:
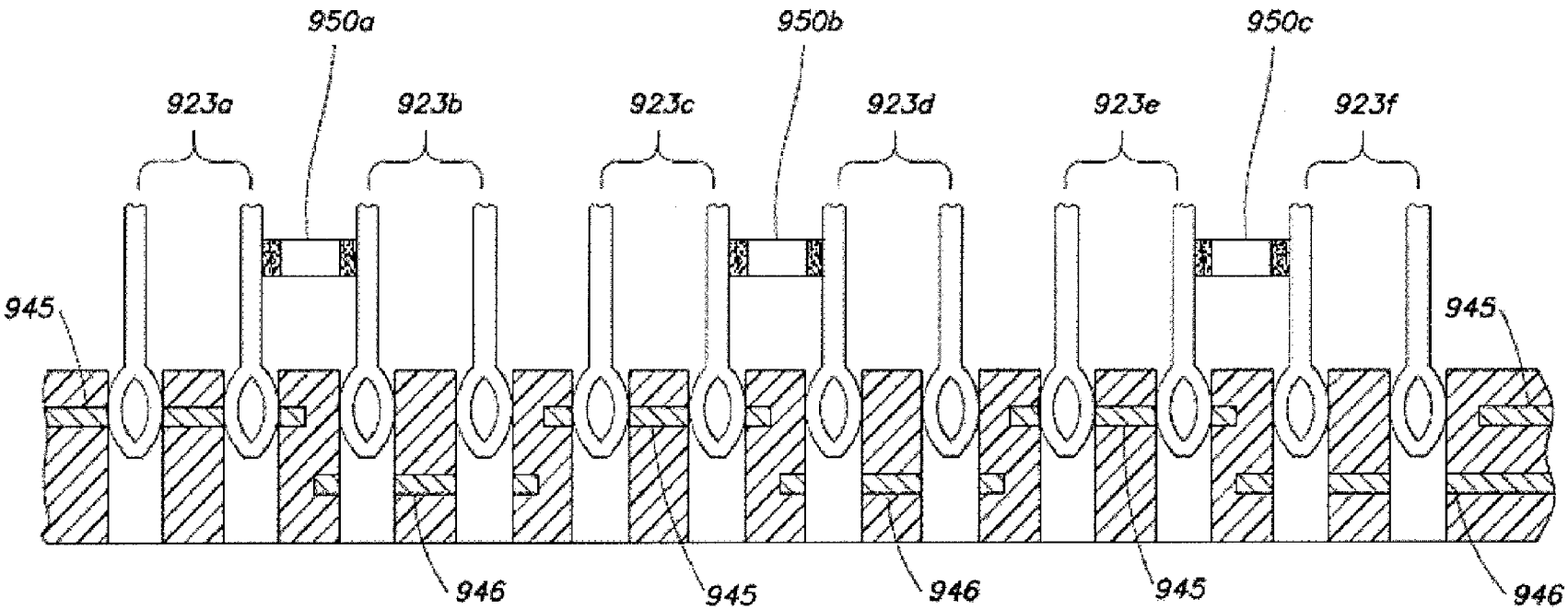
FIG. 9 is a schematic cross-sectional representation of a portion of an improved interconnection system, showing a plurality of filter elements incorporated, respectively, between pairs of conductive elements in accordance with some further embodiments of the invention.

One such embodiment is illustrated in FIG. 9, where three filter elements 950*a-c* are incorporated respectively between three pairs of conductive elements. For example, as shown in FIG. 9, filter element 950*a* is inserted between conductive elements 923*a* and 923*b*, filter element 950*b* is inserted between conductive elements 923*c* and 923*d*, and filter element 950*c* is inserted between conductive elements 923*e* and 923*f*. Conductive elements 923*a*, 923*c*, and 923*e* may be electrically coupled to a plane 945 in a PCB 940, while conductive elements 923*b*, 923*d*, and 923*f* may be electrically coupled to another plane 946. As discussed above, plane 945 may be a supply plane and conductive elements 923*a*, 923*c*, and 923*e* may be supply conductors. Similarly, plane 946 may be a ground plane and conductive elements 923*b*, 923*d*, and 923*f* may be return conductors. Thus, each of the filter elements 950*a-c* is inserted between a first conductive element from a first group comprising 923*a*, 923*c*, and 923*e* and a second conductive element from a second group comprising 923*b*, 923*d*, and 923*f*.

As discussed above, the invention is not limited to the internal composition of a filter element. For example, a filter element may comprise a capacitor in series with a resistor, or a capacitor without a resistor. The inventors have appreciated that a ferrite member may also be incorporated as part of a filter element, instead of, or in addition to, a capacitive element. Examples of ferrite materials include, but are not limited to, MnZn and NiZn ferrites. Suitable materials may have a high permeability and a low bulk conductivity. In some embodiments, materials with a bulk conductivity below 1.0 Siemens/meter may be used. In some embodiment, the bulk conductivity will be below 0.5 Siemens/meter and in yet other embodiments, below 0.1 Siemens/meter. In some embodiments, suitable materials will have a relative permeability above 100. In some embodiments, the relative permeability will be above 1000. In yet other embodiments, the relative permeability will be in the range of 1000 to 100000.

However, materials other than ferrites may be used instead of or in addition to ferrite member 1090. The inventors have recognized and appreciated that ferromagnetic material and other materials of high permeability materials, even if not ferrites, may suppress higher frequency amplification, such as is illustrated in FIG. 4 to occur above approximately 1 GHz. Examples of non-ferrite bulk materials that may be used to form members incorporated in a filter element instead of or in addition to ferrite member 1090 include slugs of high permeability pure metal, pure graphite blocks and molded plastic impregnated with metal filings, fibers or powders. In some embodiments, suitable materials will have a relative permeability above 100. In some embodiments, the relative permeability will be above 1000. In yet other embodiments, the relative permeability will be in the range of 1000 to 100000. Examples of materials that may be used include nickel, mu-metal, permalloy, Silicon GO steel and supermalloy.

Figure 10A:
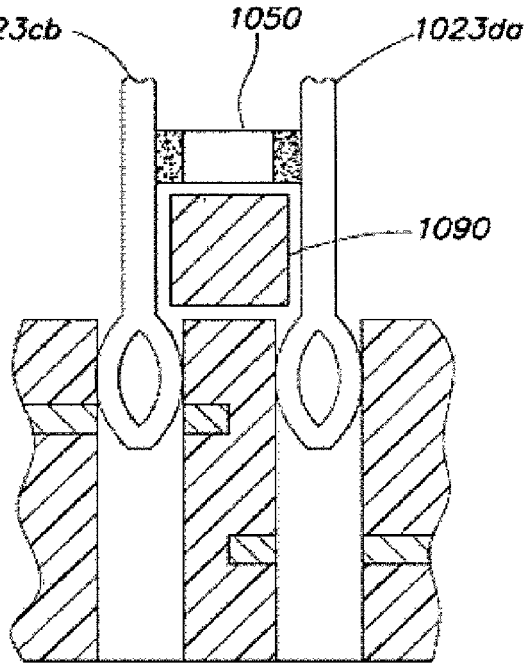
FIG. 10A is a schematic cross-sectional representation of a portion of an improved power connector with a capacitive filter element and a ferrite member between two conductive elements in accordance with some alternative embodiments of the invention.
Figure 10B:
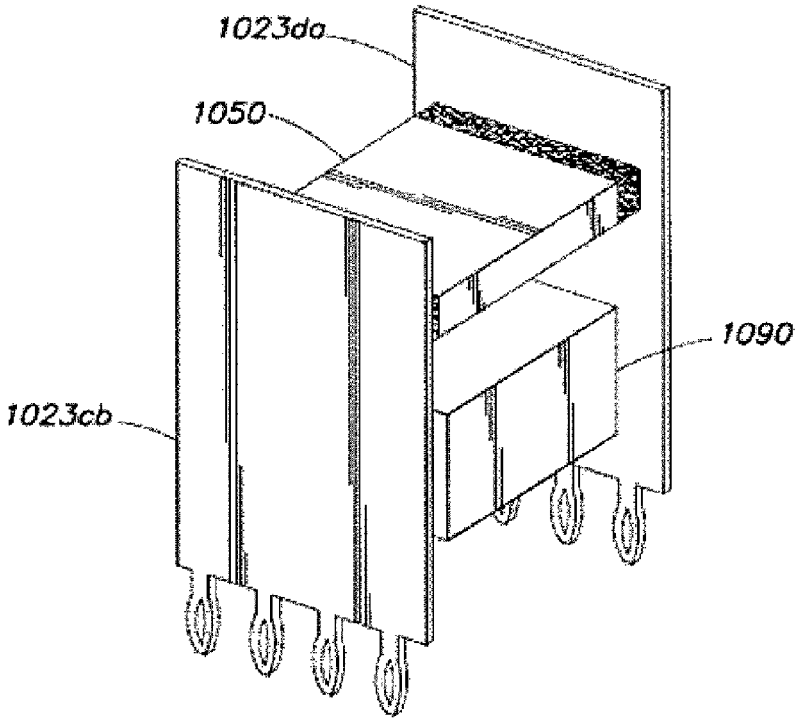
FIG. 10B is a perspective view of the conductive elements of FIG. 10A, showing the ferrite member between the two conductive elements.

Embodiments in which a ferrite member is used in addition to a capacitive element are illustrated in FIGS. 10A-B, where a ferrite member 1090 is inserted between conductor portions 1023*cb* and 1023*da* in addition to a capacitive portion 1050 of the filter element. The inventors have further recognized that, although ferrite beads have conventionally been used on cabling to reduce unwanted signal interference, the shape of a ferrite member used to provide filtering may increase the inductance of the conductive elements carrying power, and therefore negatively impact the ability of the interconnection system to deliver power. In an embodiment illustrated in FIG. 10B, the ferrite member 1090 may be positioned so that it is substantially parallel to conductor portions 1023*cb* and 1023*da*, but without encircling either of the conductor portions. This configuration may enhance the ability of the filter element to reduce high frequency noise without significantly degrading the performance of the interconnection system.

As noted above in connection with FIG. 4, incorporation of a filter element into a power connector may provide amplification to higher frequency signals. Such amplification may be suppressed, such as through the incorporation of ferrite or high permeability materials in conjunction with the filter element. Alternatively or additionally, amplification at higher frequencies may be reduced by altering the structure of conductive elements to reduce resonant effects. FIGS. 11A, 11B, 11C and 11D illustrate embodiments of a power connector with such an altered structure for the conductive elements.

Figure 11B:
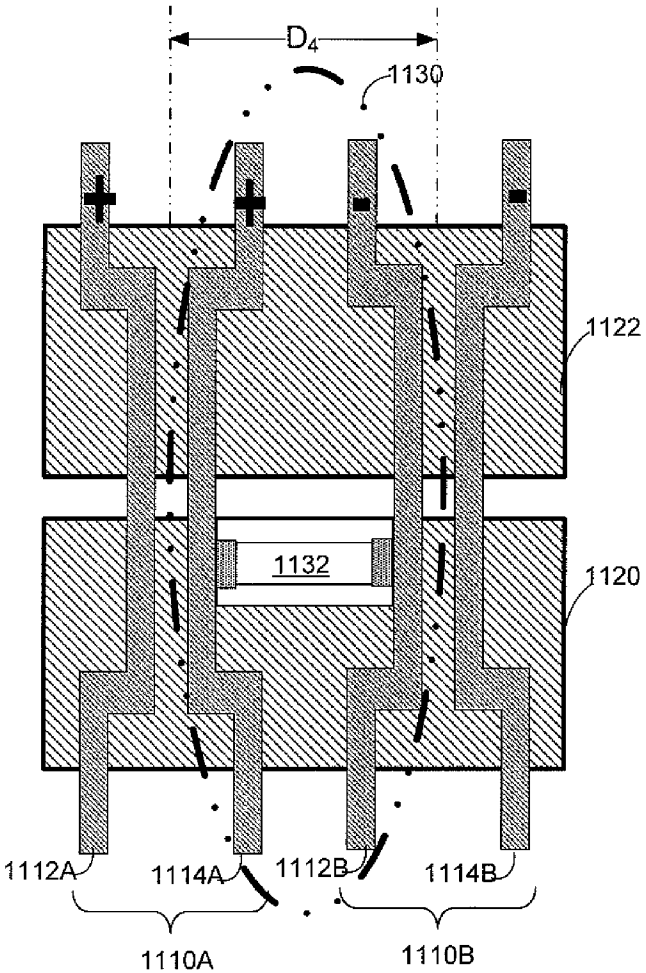
FIG. 11B illustrates a configuration of the power connector of FIG. 11A.
Figure 11A:
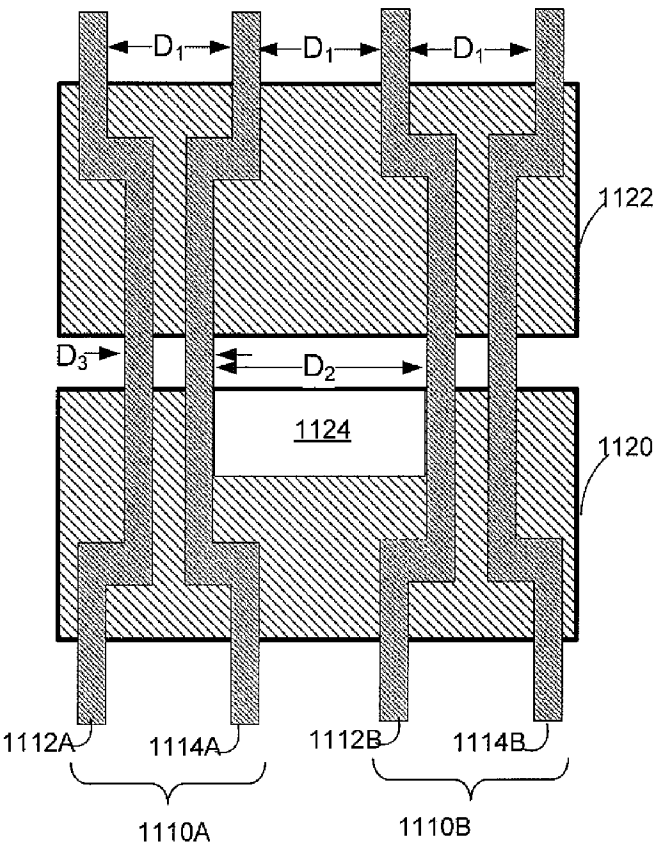
FIG. 11A is a schematic cross sectional representation of a power connector configured for reduced inductance operation to provide improved high frequency performance according to some alternative embodiments of the invention.

FIG. 11A schematically illustrates a shape of conductive elements within a power connector configured to be either supply conductors or return conductors. FIG. 11A schematically illustrates a backplane connector 1120 and a daughter card connector 1122 in a mated configuration. The conductive elements are shown schematically without a separable mating interface, but one of skill in the art will recognize that any suitable form of interface between backplane connector 1120 and a daughter card connector 1122 may be present.

In the embodiment illustrated in FIG. 11A, the conductive elements are positioned in groups. FIG. 11A shows two groups, groups 1110A and 1110B. In the embodiment illustrated, each illustrated group contains two conductive elements. Group 1110A contains conductive elements 1112A and 1114A. Group 1110B contains conductive elements 1112B and 1114B.

Though FIG. 11A shows two groups of conductive elements, any suitable number of groups may be incorporated into a connector housing. Also, though FIG. 11 illustrates a single member forming an insulative housing for each of backplane connector 1120 and daughtercard connector 1122, a single housing is not required. For example, each group of power conductors, such as groups 1110A and 1110B, could be held within a separate housing, forming separate modules. With such a modular construction, a power connector of any desired size could be constructed by attaching the modules to each other or to a common support structure or in any other suitable way.

As shown in FIG. 11A, the spacing between conductive elements may be adjusted to reduce inductance in the current loops formed thought the power connector, which may reduce inductance. In the embodiment illustrated, the conductive elements have different spacing for the contact tails and intermediate portions of the conductive elements. The contact tails extending from backplane connector 1120 and daughtercard connector 1122 are spaced by a distance of $D_1$. This spacing may be driven by the need to distribute attachment points for power conductors over a backplane or daughtercard to keep the heat density attributable to resistive heating at the interface between a conductive element and a printed circuit board below an acceptable level. However, the spacing $D_1$ may be determined based on any other factors. As an example, the spacing $D_1$ may be sufficient to provide a center to center spacing of at least 1.5 millimeters between contact tails for the conductive elements. In some embodiments, the spacing will be 2 millimeters or greater. Though, the specific spacing between contact tails is not critical to the invention.

In some embodiments, resonant affects may be reduced by reducing the inductance of a loop carrying power current. To facilitate such a connection, FIG. 11A shows conductive members within each group with a relatively small spacing between them. In the embodiment illustrated, this spacing is achieved by offsetting the conductive elements toward each other. Accordingly, conductive members 1112A and 1114A are offset towards each other such that the spacing between the conductive members within the group within the bodies of backplane connector 1120 and daughtercard connector 1122, is a distance $D_3$. As a result, the spacing, center to center between conductive elements in adjacent groups is $D_2$. For example, the center to center spacing between conductive elements within a group labeled $D_3$ in FIG. 11A maybe 2 millimeters or less. In some embodiments the spacing may be less than 1 millimeter. In yet other embodiments, the spacing may be between approximately 0.3 and 0.7 millimeters.

As shown, backplane connector 1120 is formed with a cavity 1124 adapted to receive a filter element. Accordingly, the connector illustrated in FIG. 11A may be configured with a filter element and used in a configuration similar to that illustrated in connected with FIG. 2, above. FIG. 11B illustrates the connector of FIG. 11A in such a configuration. In this embodiment, filter element 1132 has been incorporated into cavity 1124. As shown, the groups of conductive elements are connected to provide groups of supply conductors and groups of return conductors. Conductors 1112A and 1114A within group 1110A have been configured as supply conductors. Conductors 1112B and 1114B within group 1110B are configured as return conductors.

A current loop 1130 flows through group 1110A in the supply direction and through the group 1110B in the return direction. In this configuration, the size of the current loop 1130 is driven by the spacing between groups, illustrated in FIG. 11B as the distance $D_4$.

FIG. 11C illustrates an alternative use of the connector of FIG. 11A that may reduce the inductance of current paths, therefore reducing resonant effects. As shown, conductive elements within each of the groups have been configured as supply and return conductors. For example, within group 1110A, conductive element 1112A has been connected as a supply conductor and conductive element 1114A is connected as a return conductor. Likewise, within group 1110B, conductive element 1112B is connected as a supply conductor and conductive element 1114B has been connected as a return. Accordingly, in the embodiment of FIG. 11C, two conducting loops 1132A and 1132B are formed. Each of the conducting loops has a width $D_3$ corresponding to the spacing between conductive elements of the same group. As can be seen from a comparison of FIGS. 11B and 11C, current loops 1132A and 1132B are smaller than current loop 1130. As a result, the inductance in the power paths for the scenario of FIG. 11C is less than that shown in FIG. 11B, which can decrease gain at the resonant frequency and/or increase the resonant frequency.

Though not illustrated in FIG. 11C, a filter element could also be incorporated in cavity 1124.

FIG. 11D shows a further configuration for the connector illustrated in FIG. 11A. In the embodiment of FIG. 11D, conductive elements within each of the groups are connected as supply and return conductors. In contrast to FIG. 11C in which groups of conductive elements are connected in a repeating pattern of supply, return, supply, return, the conductive elements in FIG. 11D are configured in an alternating pattern of supply, return, return, supply. Accordingly, conductive elements 1112A and 1114B are shown connected as supply conductors. Conductive elements 1114A and 1112B are connected as return conductors. This configuration results in conductive elements of the same type being adjacent to each other. As a result, the same conductive structure within a printed circuit board to which a connector is attached may be connected to more than one conductive element. For example, FIG. 11D schematically illustrates a routing member 1140 within a backplane to which backplane connector 1120 is mounted. As shown, makes connections to both conductive members 1114A and 1112B. Consequently, fewer routing members are required to connect the contact tails of the power connector configured as illustrated in FIG. 11D, making it easier to design and/or manufacture a printed circuit board assembly than in the configuration of 11C. However, FIG. 11D provides the same reduction in inductance illustrated in FIG. 11C.

Having thus described several aspects of at least one embodiment of this invention, it is to be appreciated various alterations, modifications, and improvements will readily occur to those skilled in the art.

For example, though filter elements are shown incorporated in a backplane connector, the filter elements may be incorporated in any suitable location, including in a daughtercard connector.

Such alterations, modifications, and improvements are intended to be within the spirit and scope of the invention. For example, a power connector may be of a form different from those illustrated in the figures. More specifically, a power connector may comprise both power and signal conductors within the same housing, or a power module integrated with a signal module in a connector assembly. Accordingly, the foregoing description and drawings are by way of example only.

What is claimed is:

1. A power connector comprising:

a housing;

a first plurality of power contact elements within the housing;

a second plurality of power contact elements within the housing; and a filter element within the housing, the filter element being disposed between the first plurality and the second plurality of power contact elements and electrically coupled between a power contact element of the first plurality of power contact elements and a power contact element of the second plurality of power contact elements, the filter element comprising at least one material having relative permeability above 100.

2. The power connector of claim 1, wherein the first plurality of power contact elements are disposed in a line and the second plurality of power contact elements are disposed in the line adjacent the first plurality of power contact elements.

3. The power connector of claim 1, wherein an inductance of the filter element is less than 10% of the inductance of a conducting loop through the power connector incorporating a power contact element of the first plurality of power contact elements and a power contact element of the second plurality of power contact elements.

4. The power connector of claim 1 in combination with a substrate having a supply plane and a ground plane, wherein the first plurality of power contact elements are each mounted to the supply plane and the second plurality of power contact elements are each mounted to the ground plane.

5. The power connector in the combination of claim 4, wherein the power connector has a single filter element.

6. The power connector of claim 1, wherein the at least one material having relative permeability above 100 has relative permeability above 1000.

7. The power connector of claim 1, wherein a conducting path comprising a power contact element of the first plurality and a power contact element of the second plurality provides, while carrying a current equal to 10 Amperes per power contact element in the first plurality of power contact elements:

substantially no attenuation at frequencies below 5 MHz;

an attenuation of greater than 10 dB over the range of 50 MHz to 500 MHz; and no gain above 10 dB at frequencies less than 500 MHz.

8. The power connector of claim 1, wherein the at least one material having relative permeability above 100 comprises a ferrite material.

9. The power connector of claim 1, wherein the filter element further comprises a capacitor.

10. A power connector comprising:

a housing;

a first plurality of power contact elements within the housing;

a second plurality of power contact elements within the housing; and a filter element within the housing, the filter element being disposed between the first plurality and the second plurality of power contact elements and electrically coupled between a power contact element of the first plurality of power contact elements and a power contact element of the second plurality of power contact elements, wherein the first plurality of power contact elements are disposed in a line and the second plurality of power contact elements are disposed in the line adjacent the first plurality of power contact elements, and wherein the filter element comprises a capacitor and resistor.

11. The power connector of claim 10, wherein the filter element further comprises a ferrite member.

12. The power connector of claim 10, wherein the filter element has a capacitance in the range of 0.05 to 0.2 microFarads and a resistance in the range of 0.1 to 1 Ohms.

13. The power connector of claim 12, wherein the filter element has an inductance less than 10 nanoHenries.

14. The power connector of claim 13, wherein the capacitor and the resistor are incorporated into a single component package.

15. A power connector comprising:

a housing;

a first plurality of power contact elements within the housing;

a second plurality of power contact elements within the housing; and a filter element within the housing, the filter element being disposed between the first plurality and the second plurality of power contact elements and electrically coupled between a power contact element of the first plurality of power contact elements and a power contact element of the second plurality of power contact elements, wherein each of the first plurality of power contact elements and each of the second plurality of power contact elements has a width in excess of 0.5 cm, and wherein:

the filter element comprises a first end and a second end, the first end comprising a first conductive end cap and the second end comprising a second conductive end cap;

the first end cap is electrically connected to a power contact element of the first plurality of power contact elements across at least 80% of the width of said power contact element of the first plurality; and the second end cap is electrically connected to a power contact element of the second plurality of power contact elements across at least 80% of the width of said power contact element of the second plurality.

16. The power connector of claim 15, wherein the filter element has a capacitance in the range of 0.05 to 0.2 microFarads and a resistance in the range of 0.1 to 1 Ohms.

17. The power connector of claim 15, wherein an inductance of the filter element is less than 10% of the inductance of a conducting loop through the power connector incorporating the power contact element of the first plurality of power contact elements and the power contact element of the second plurality of power contact elements.

18. A power connector comprising:

a housing;

a first power contact element within the housing, the first power contact element being designated as a supply contact;

a second power contact element within the housing, the second power contact element being designated as a return contact; and a filter element within the housing, the filter element being disposed between the first power contact element and the second power contact element, the filter element having properties such that, while the first and second power contact elements are connected in a loop carrying a current of 10 Amperes, the loop provides:

substantially no attenuation at frequencies below 5 MHz:

an attenuation of greater than 10 dB over the range of 50 MHz to 500 MHz; and no gain above 10 dB at frequencies less than 500 MHz.

19. The power connector of claim 18, further comprising:

a plurality of pairs of power contact elements, each pair comprising a power contact element designated as a supply contact and a power contact element designated as a return contact; and a plurality of filter elements, each of the plurality of filter elements being disposed between a supply contact and a return contact of a pair of the plurality of pairs.

20. A power connector comprising:

a housing;

a first power contact element within the housing; and a second power contact element within the housing, wherein the housing comprises a region adapted and configured to receive a filter element within the housing, the region being disposed between the first power contact element and the second power contact element, and wherein:

the first power contact element has a width between a first edge and a second edge in excess of 0.5 cm;

the second power contact element has a width between a third edge and a fourth edge in excess of 0.5 cm;

the filter element is a first filter element and the region is adapted and configured to receive a second filter element, the region being adapted and configured to position the first filter element for electrical attachment to the first power contact adjacent the first edge and to the second power contact adjacent the third edge; and the region is adapted and configured to position the second filter element for electrical attachment to the first power contact adjacent the second edge and to the second power contact adjacent the fourth edge.

21. The power connector of claim 20, further comprising two discrete filter elements disposed within the region.

22. The power connector of claim 21, wherein each discrete filter element comprises a capacitor with a capacitance in excess of 0.05 microFarads and an effective series resistance in excess of 0.1 Ohms.

23. The power connector of claim 20, further comprising a filter element disposed within the region, the filter element comprising a capacitor having a first end and a second end, the first end and the second end each having a width in excess of the 0.3 cm, and the first end being coupled to the first power contact element and the second end being coupled to the second power contact element.

24. A method of operating a circuit assembly comprising a power connector, the method comprising:

coupling power from a power supply to a circuit assembly through a separable connector, the connector comprising a plurality of power contact elements, each power contact element carrying current of at least 10 Amperes;

filtering the power using a filter element disposed within the connector, the filter element electrically connected between a first power contact element and a second power contact element of the plurality of power contact elements, and the filter element having a capacitance in the range of 0.05 to 0.2 microFarads, a resistance in the range of 0.1 to 1 Ohms, and an inductance less than 10 nanoHenries.

25. The method of claim 24, further comprising inserting the filter element into a receptacle in the power connector.

26. A power connector comprising:

a housing;

a first power contact element within the housing; and a second power contact element within the housing, wherein the housing comprises a region adapted and configured to receive a filter element within the housing, the region being disposed between the first power contact element and the second power contact element, and wherein:

the first power contact element comprises a first substantially planar portion and a first tab extending from the first substantially planar portion into the region;

the second power contact element comprises a second substantially planar portion parallel and adjacent to the first substantially planar portion and a second tab extending from the second substantially planar portion into the region; and the first tab and the second tab each comprises a compliant member adapted to be coupled to a filter element through a spring force.

27. The power connector of claim 26, further comprising a filter element disposed within the region, the filter element comprising a capacitor having a first end and a second end, the first end being coupled to the first tab and the second end being coupled to the second tab.

28. The power connector of claim 26, wherein the housing comprises a first insulative wall adjacent the first substantially planar portion of the first power contact element and a second insulative wall adjacent the second substantially planar portion of the second power contact element, and wherein the first tab extends into the region through a first opening in the first insulative wall and the second tab extends into the region through a second opening in the second insulative wall.

* * * * *